United States Patent [19]
Johnson et al.
[11] 4,295,337
[45] Oct. 20, 1981

[54] COOLING APPARATUS AND METHOD IN A LIQUID CRYOGEN TREATMENT PROCESS

[75] Inventors: Harry D. Johnson, Glen Allen; Christopher J. Campbell, Richmond, both of Va.; Thomas O. Turner, Midland; Carl W. Poole, Concord, both of N.C.; James E. Gilmore; James R. Thomas, both of Mauldin, S.C.

[73] Assignee: Philip Morris Incorporated, New York, N.Y.

[21] Appl. No.: 106,671

[22] Filed: Dec. 26, 1979

[51] Int. Cl.[3] ..... F17C 13/00
[52] U.S. Cl. ..... 62/54; 62/64; 62/228; 62/384; 220/85 VS
[58] Field of Search ..... 62/54, 63, 64, 228, 62/374, 384; 220/85 VR, 85 VS

[56] References Cited

U.S. PATENT DOCUMENTS 3,303,660 2/1967 Berg ..... 62/54
4,165,618 8/1979 Tyree, Jr. ..... 62/64
4,187,325 2/1980 Tyree, Jr. ..... 62/64

*Primary Examiner*—Ronald C. Capossela
*Attorney, Agent, or Firm*—Arthur I. Palmer, Jr.

[57] ABSTRACT

Compressors are utilized in an apparatus for treating a product such as tobacco with a liquid cryogen, such as carbon dioxide for removing vapor from a processing chamber and recompressing the vapor to facilitate its return to the cryogen system. When the compressors do not receive a supply of cool vapor from the processing chamber, the compressor temperature rises and the pressure drops. When the pressure reaches a predetermined minimum setpoint, the compressors are interconnected by means of a remotely controlled valve to a vessel containing cryogen vapor at a pressure greater than the pressure at the compressors. A supply of cool cryogen vapor thus flows to the compressors to reduce the temperature, thereby allowing continuous operation of the compressors during periods in which cryogen vapor flow from the processing chamber is interrupted or delayed.

11 Claims, 1 Drawing Figure

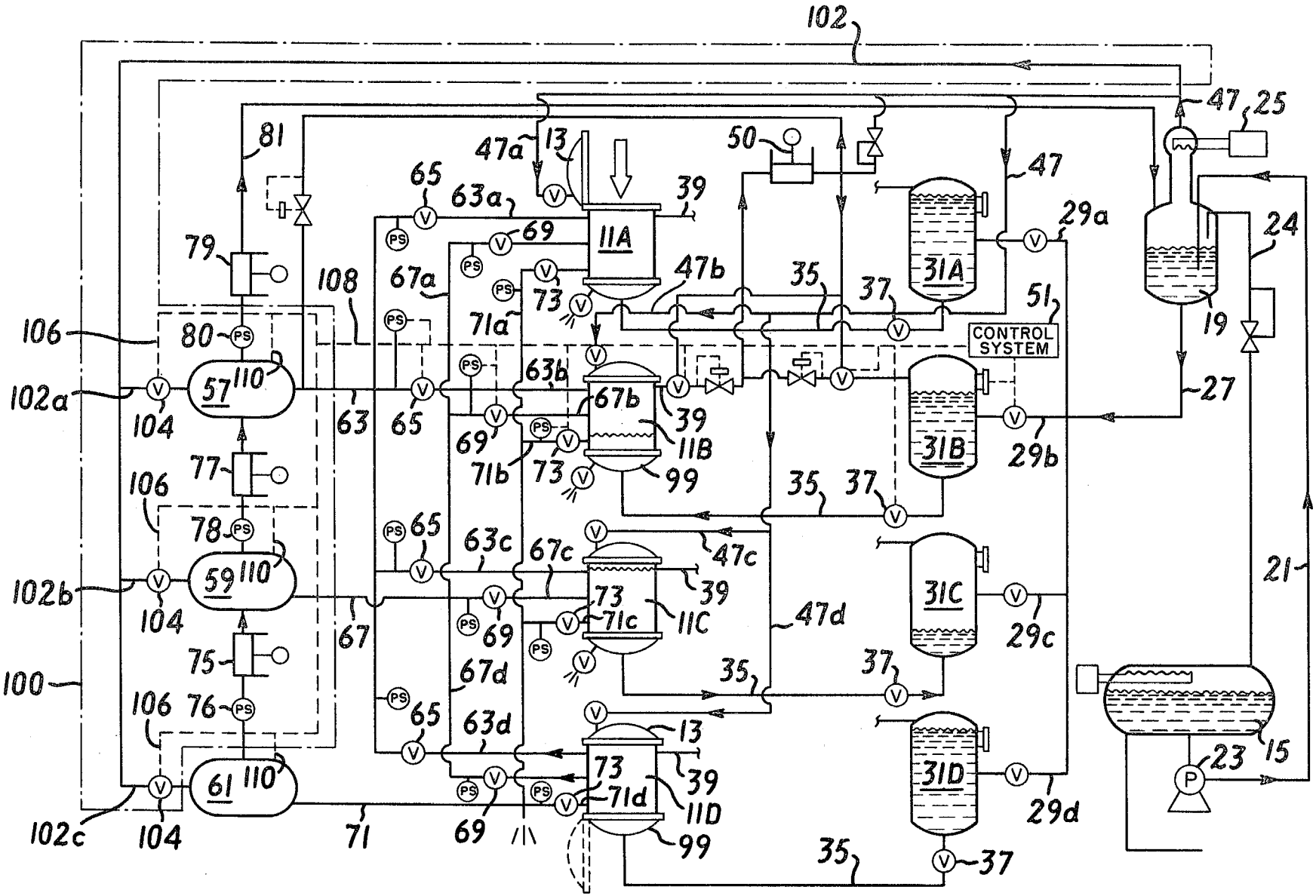
CONTROL SYSTEM
31A
31B
31C
31D
11A
11B
11C
11D
57
59
61
110
P
PS
V

COOLING APPARATUS AND METHOD IN A LIQUID CRYOGEN TREATMENT PROCESS

BACKGROUND OF THE INVENTION

1. Field of the Invention

This invention relates to an improved method and apparatus for treating a product with a liquid cryogen and more particularly to an improvement for providing efficient cooling of the cryogen vapor recovery arrangement.

2. Description of the Prior Art

The use of liquid cryogens for refrigeration and other processing of products has increased significantly with the increase in availability of cryogens, such as, for example, nitrogen, oxygen, argon, hydrogen, helium, methane, freons, carbon monoxide and carbon dioxide. One fairly recently discovered use involves the expansion of tobacco in which liquid carbon dioxide is employed as the expansion agent. A process and apparatus for so expanding tobacco are described in patent applications U.S. Ser. No. 441,767, filed by Roger Z. de la Burde and Patrick E. Aument on Feb. 12, 1974, and U.S. Ser. No. 822,793, now abandoned, filed by Larry M. Sykes and Ray G. Snow on Aug. 8, 1977, both applications being assigned to the same assignee as is the present invention. With the development of such cryogen systems, it has also become important, due in part to energy costs, to minimize the expenditure of cryogens whenever feasible. Arrangements for efficiently recovering large quantities of cryogen vapor, particularly without adversely affecting the overall treatment process have been developed. One such vapor recovery process is disclosed in U.S. Pat. No. 4,165,618 to Lewis Tyree, Jr., issued on Aug. 28, 1979.

The recovery system as described in U.S. Pat. No. 4,165,618 utilizes a plurality of gas receivers that are maintained at different predetermined pressures by means of multiple compressors. The overall system accomplishes an efficient recovery of cryogen vapor which can then be reliquified and returned to the overall cryogen treatment system. It is contemplated that the compressors in the recovery system will run substantially continuously whenever the product treatment is being carried out. One reason for such expected continuous operation is that the compressors are fairly large and starting and stopping these units are relatively timely operations affecting both production efficiency and cost.

The compressors in these recovery systems are typically connected via the gas receivers to a product processing chamber from which cryogen vapor is recovered. When the compressors are loaded, i.e., compressing the cryogen vapor withdrawn from the processing chamber, heat is removed by the flow of the cool cryogen vapor into the compressor. For continuous operation of the compressors, it is necessary in preventing overheating of the compressors that the cool cryogen vapor be withdrawn from the processing chamber fairly continuously or on a fairly regular basis without extensive delays. Thus, a problem arises when the flow of cryogen vapor to the compressors is interrupted due to unexpected equipment malfunctions, leaks or electrical breakdowns. The current recovery systems provide no compensation short of undesirably turning off the compressors to prevent frictional heat build up which could result in ineffective compressor performance or ultimately, compressor failure.

Therefore, it is desirable to provide an arrangement that will effectively cool the compressors while permitting continuous operation of the compressors during an unexpected interruption in the flow of cryogen to the compressors or during temporary maintenance periods.

SUMMARY OF THE INVENTION

In accordance with the invention there is provided an improved apparatus and method for processing a product by treatment with a liquid cryogen in which the cryogen vapor recovery arrangement is effectively cooled during substantially continuous operation thereof.

The processing apparatus is of the type including a processing chamber having means for introducing and withdrawing product and a source for supplying cryogen vapor to the chamber at superatmospheric pressure. Included in the apparatus is means for supplying and removing liquid cryogen to the chamber and compressing means interconnected to the processing chamber for effecting withdrawal and recovery of cryogen vapor therefrom upon removal of the liquid cryogen from the processing chamber. This apparatus is improved in accordance with the invention by including means interconnected between the vapor source and the compressing means for supplying vapor to the compressing means. Further included is means responsive to a predetermined pressure at the compressing means for effecting the supply of the vapor to the compressing means, the predetermined pressure being lower than the pressure at the vapor source.

In the preferred form the compressing means, comprising a compressor and a gas receiver, is coupled to the vapor source by a vapor supply line with a remotely controlled valve to control the vapor flow. If the pressure falls to or below the predetermined pressure as a result of not receiving cryogen vapor from the processing chamber, the valve is opened and provides additional vapor from the vapor source to cool the compressor. The valve may also be regulated to open after the pressure has been reduced to or below the predetermined pressure for a predetermined period of time.

In accordance with the present invention, the process for treating the product by a liquid cryogen, preferably tobacco with liquid carbon dioxide, is also improved. The improvement is achieved by monitoring the pressure in the compressing means and when the pressure is at or below the predetemined pressure, vapor from the vapor source is supplied to the compressing means.

BRIEF DESCRIPTION OF THE DRAWING

The sole drawing FIGURE is a schematic representation of one representative arrangement of an improved apparatus for treating a product with a liquid cryogen in accordance with the present invention.

DETAILED DESCRIPTION OF THE PREFERRED EMBODIMENTS

Referring to the drawing, the schematic representation as shown herein, with the exception of the improved cooling arrangement 100 (shown in phantom lines in the FIGURE) is identical to the FIGURE of U.S. Pat. No. 4,165,618 to Lewis Tyree, Jr., issued on Aug. 28, 1979, and herein incorporated by reference. The present invention is directed to an improvement over the apparatus and method disclosed by Tyree, in particular, to the cryogen vapor recovery arrangement. Therefore, only a brief description of the schematic as it relates to the Tyree patent is given herein so as to permit an understanding of the present improvement thereon. Corresponding numerals are utilized in this description to facilitate reading with the referenced patent.

In the illustrated schematic, there are four treatment or processing chambers 11A, 11B, 11C and 11D, each of which is provided with a hinged upper lid 13 through which material can be gravity fed and a hinged bottom 99 to allow withdrawal of the product gravitationally onto a conveyor or the like. In the preferred form, the product being treated is tobacco, although foods and other products may also be used. For processing the tobacco, the preferred cryogen is carbon dioxide.

A standard carbon dioxide liquid storage vessel 15 is depicted that is designed for storage of liquid carbon dioxide at about 315 psia, which has an equilibrium temperature of about 0° F. An intermediate vessel 19 acts as a reservoir and it is connected by a liquid line 21, which includes a high pressure pump 23, to the liquid side of the storage vessel 15. A vapor interconnection line 24 between the two vessels 15 and 19 is also provided. The intermediate vessel 19 may be maintained at any desired elevated pressure, and for carbon dioxide, this may be about 915 psia.

A liquid supply line 27 leads from the bottom of the intermediate tank 19 to a manifold which splits the flow into a separate feed line 29*a*, 29*b*, 29*c* and 29*d* leading to four separate holding chambers 31A, 31B, 31C and 31D, each of which is interconnected with one of the four treatment chambers. A liquid transfer line 35 interconnects the lower portions of each pair of treatment chambers 11 and holding chamber 31, and a remote-controlled valve 37 is contained in the line 35. A vapor line 39 is connected to the top of each treatment chamber 11, the valves associated with the vapor lines for each set of chambers being connected to a control system 51. A purge gas line 47 is provided which is branched and each branch 47*a*, 47*b*, 47*c*, and 47*d* connects to one of the treatment chambers 11 at an upper location therein. A compressor 50 is provided to control the pressure in the treatment and holding chambers and to create the desired transfer of liquid therebetween by differential pressure.

To recover the vapor from the treatment chambers 11 following the treatment of the product with liquid cryogen, three separate gas receivers 57,59,61 are provided. The high pressure gas receiver 57 is connected by an inlet line 63 which contains a check valve, and this line is branched so that an individual line 63*a*, 63*b*, 63*c*, 63*d* leads to each of the four treatment chambers. Each branch 63 includes a remote-controlled valve 65. Similarly, the intermediate pressure gas receiver 59 is connected to an intake line 67 containing a check valve and by branches 67*a*, 67*b*, 67*c*, 67*d* to each of the four treatment chambers 11. Each of the four branches contains a remote-controlled valve 67. The lower pressure gas receiver 61 is likewise connected by an intake line 71 containing a check valve to four branch lines 71*a*, 71*b*, 71*c*, 71*d* which lead to each of the four treatment chambers, and each branch line contains a remote-controlled valve 73. All of the remote-controlled valves are respectively electrically interconnected to the control system 51 for the particular set.

A compressor 75 takes its suction from the low pressure gas receiver 61 and discharges to the intermediate pressure gas receiver 59. This compressor 75 can be suitably controlled via a pressure switch 76 to operate so long as the pressure in the low pressure gas receiver exceeds a predetermined minimum, for example 30 psia when the cryogen is carbon dioxide. Another compressor 77, which may be a single-stage compressor, takes its suction from the intermediate pressure gas receiver 59, discharges into the high pressure gas receiver 57, and is controlled by a pressure switch 78. This compressor 77 may be set to run so long as the gas pressure exceeds a higher minimum, for example about 110 psia when the cryogen is $CO_2$. A third compressor 79 takes its suction from the high pressure gas receiver 57 and discharges to a vapor return line 81 leading to the intermediate tank 19 where the vapor is condensed to liquid by the condenser 25. This compressor 79 is controlled by a pressure switch 80 and may be set to run so long as the pressure in the gas receiver 57 exceeds about 250 psia, when the cryogen is $CO_2$; however, the compressor 79 must be capable of raising the pressure to about 915 psia.

The processing chambers are filled with tobacco, the processing chambers purged, liquid carbon dioxide is supplied to the processing chambers to impregnate the tobacco and removed after the tobacco is saturated and cryogen vapor is then withdrawn from the processing chambers and recovered all as described in U.S. Pat. No. 4,165,218. In accordance with this operation, the processing in each of the chambers is effected sequentially. In order for the compressors in the cryogen vapor recovery arrangement to run continuously, it is contemplated that the processing chambers be sequentially interconnected to the gas receivers without extensive delays so as to continue to supply cool vapor to the compressors to prevent overheating.

In accordance with the present invention an improved cooling arrangement 100 is provided that will permit continuous cool operation of the compressors during periods that vapor from the processing chambers to the receivers is interrupted or unduly delayed. As described hereinabove, process conditions or equipment malfunctions sometimes cause curtailment or stoppage of the cryogen vapor flow to the receivers 57, 59 and 61 causing the compressors 75, 77 and 79 to become unloaded and cease compressing. While the compressors are unloaded, the reciprocating action of the piston produces frictional heat which undesirably increases the temperature of the compressor cylinder since no cool cryogen vapor is available to keep the temperature at a suitable operating temperature. The unloading of the compressors is manifested by a reduction in the pressure in the receivers 57, 59 and 61. As the compressor becomes unloaded and the temperature in the cylinder increases during operation, the pressure in the receivers will decrease. If the pressure reaches a minimum setpoint the present invention will provide additional cooling vapor to the compressors as will be explained instead of undesirably shutting down the compessors as is the current practice.

To provide additional vapor to the compressors, a vapor supply line 102 is connected to the upper location of the high pressure intermediate vessel 19, line 102 being connected to each of the gas receivers 57, 59 and 61 by line branches 102*a*, 102*b* and 102*c*, respectively. Each branch 102*a*, 102*b* and 102*c* includes a remote-controlled valve 104. Each valve 104 is connected as by a line 106 to a lead 108 that connects the improved cooling arrangement 100 to the main control system 51.

Each of the receivers 57, 59 and 61 is connected as by a line 110 through lead 108 to the control system 51 to allow monitoring of the pressures in the receiver during operation.

In operation, the pressure in the receivers 57, 59 and 61 is monitored by the control system 51. If the pressure in any of the receivers, for example, receiver 57 is reduced to a predetermined setpoint, a signal is generated to open valve 104, thereby allowing the receiver 57 to be interconnected to the intermediate vessel 19 for supplying cool vapor from vessel 19, vessel 19 being at a higher pressure than the pressure in the receivers. The minimum setpoint is selected to be a pressure higher, for example by about 10 psia, than the predetermined minimum pressure at which the pressure switches 76, 78 and 80 are set to turn off the operation of the compressors 75, 77 and 79, respectively. In a preferred embodiment of the cooling arrangement, the valves 104 are remotely opened when the pressure in the receivers is at or below the predetermined setpoint for a predetermined period of time. Such a time delay is desirable for example when the liquid carbon dioxide is being drained from the chambers in the so-called "delayed drain sequence". When this sequence commences, a signal is received by the control system 51 indicating start of the delayed drain which has a duration, for example, of about 3 minutes. At the completion of the delayed drain, the processing chamber being drained will be interconnected to the appropriate receiver making cooling vapor available to the compressor. Thus, a delay in the opening of valve 104 after the pressure in the receiver has reached the predetermined setpoint at least for the duration of the delayed drain period would mean that the additional flow of vapor from vessel 19 would not be required once the control system 51 has received a signal that a processing chamber is in the delayed drain sequence.

This same procedure is continued for each receiver and compressor until a treatment chamber 11 is sequentially interconnected to one of the receivers. At that time the valves 104 close and the compressors decrease the pressure in the receivers to allow them to receive the vapor from the cooling chamber.

Although the present invention has been described with respect to the illustrated schematic which shows three receivers and compressors in the vapor cryogen recovery arrangement, it should be understood that various arrangements using one or more compressors and receivers may also be used. In one example two receivers, i.e., receiver 57 and 59, are employed. In operation, the predetermined minimum pressures as controlled by pressure switches 80 and 78 was set at 125 psia, respectively. The minimum setpoint was selected to be 10 psia over these minimum pressures. Thus, the setpoint pressures were 135 psia for receiver 57 and 35 psia for receiver 59.

What is claimed is:

1. In an apparatus for processing a product by treatment with a liquid cryogen, said apparatus including a processing chamber having means for introducing and withdrawing product, a source for supplying cryogen vapor to said chamber at superatmospheric pressure, means for supplying liquid cryogen to said chamber and removing liquid cryogen therefrom and compressing means interconnected to said processing chamber for effecting withdrawal of cryogen vapor therefrom upon removal of liquid cryogen from said processing chamber and compression of such vapor, the improvement comprising:

selectively operable means interconnected between said vapor source and said compressing means for supplying vapor to said compressing means; and means responsive to a predetermined pressure at said compressing means for acutating said selectively operable vapor supply means, said predetermined pressure being lower than the pressure at said vapor source.

2. An apparatus according to claim 1, wherein said actuating means includes means for actuating said selectively operable vapor supply means when the pressure at said compressing means is at or below said predetermined pressure for a predetermined period of time.

3. An apparatus according to claim 1, wherein condensing means is provided, said compressing means comprising a gas receiver and a compressor, said gas receiver being connected to said processing chamber, said compressor being connected to take suction from said receiver and to discharge to said condensing means, said selectively operable vapor supply means including a remotely controlled valve interconnected between said receiver and said vapor source.

4. An apparatus according to claim 3, in which said actuating means includes control means for monitoring the pressure in said gas receiver and for actuating said remotely controlled valve.

5. An apparatus according to claim 4, wherein said compressing means includes a first and second gas receivers, a high pressure compressor and a low pressure compressor, said low pressure compressor being connected to take suction from said second receiver and to discharge to said first receiver, said high pressure compressor being connected to take suction from said first receiver and to discharge to said condensing means, wherein means is provided to sequentially interconnect said processing chamber to said first receiver and then subsequently to said second receiver, wherein said apparatus further includes means responsive to the interconnection of said processing chamber to said gas receivers for terminating the supply of vapor from said vapor source to said compressing means.

6. In a process for treating a product with a liquid cryogen including:

supplying liquid cryogen to a processing chamber containing a product to be treated and removing said liquid cryogen from such chamber;

supplying cryogen vapor to said processing chamber from a source containing vapor at superatmospheric pressure; and withdrawing said cryogen vapor by interconnecting upon the removal of liquid cryogen the processing chamber and a compressing means in fluid communication to thereby recover said cryogen vapor, the improvement comprising;

monitoring the pressure at said compressing means, and supplying vapor from said source to said compressing means when said pressure at said compressing means is at or below a predetermined pressure, said predetermined pressure being less than superatmospheric pressure at said source.

7. A process according to claim 6, further including:

monitoring the time at which the said compressing means is at or below said predetermined pressure; and effecting said supply of cryogen vapor from said source to said compressing means when said pressure at said compressing means is at or below said predetermined pressure for a predetermined period of time.

8. A process according to claim 7, wherein said product is tobacco.

9. A process according to claim 8, wherein said cryogen is carbon dioxide.

10. In a process for treating a product with a liquid cryogen including:

supplying liquid cryogen to a processing chamber containing a product to be treated and removing said liquid cryogen from such chamber;

supplying cryogen vapor to said processing chamber from a source containing vapor at superatmospheric pressure; and withdrawing said cryogen by interconnecting upon the removal of liquid cryogen the processing chamber and a compressing means in fluid communication to thereby recover said cryogen vapor, the improvement comprising:

interconnecting said source and said compressing means in fluid communication when the pressure as monitored in the compressing means is at or below a predetermined pressure and upon a monitored delay in the interconnection of said processing chamber with said compressing means for a predetermined period of time, said predetermined pressure being less than the superatmospheric pressure at said source; and cooling said compressing means by supplying said cryogen vapor to said compressing means from said source.

11. A process according to claim 1, which further comprises terminating the interconnection between said compressing means and said source upon the interconnection of said processing chamber and said compressing means.

* * * * *